US006613103B2

(12) United States Patent
Immediato et al.

(10) Patent No.: US 6,613,103 B2
(45) Date of Patent: Sep. 2, 2003

(54) METHOD FOR DYEING FABRIC COMPRISING ELASTOMERIC FIBER

(75) Inventors: Robert F Immediato, Wilmington, DE (US); Ronald R Luongo, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 67 days.

(21) Appl. No.: 09/735,558

(22) Filed: Dec. 13, 2000

(65) Prior Publication Data

US 2002/0069467 A1 Jun. 13, 2002

(51) Int. Cl.[7] ..... D06P 3/24
(52) U.S. Cl. ..... 8/636; 8/926
(58) Field of Search ..... 8/926, 400, 478, 8/515, 445, 606, 576, 464, 636; 252/8.84, 8.81, 8.82; 524/765

(56) References Cited

U.S. PATENT DOCUMENTS 3,653,798 A 4/1972 Boardman
5,230,709 A * 7/1993 Holfeld et al. ..... 8/400
5,399,616 A 3/1995 Kuhn et al.
5,648,010 A * 7/1997 Dewitt et al. ..... 252/8.84

FOREIGN PATENT DOCUMENTS

CA 1 583 795 2/1981

OTHER PUBLICATIONS

Houser, N., Wet Processing of Cotton/Spandex Fabric, AATCC Symposium, Elastic Fibers, Nov. 2–3, 1998, pp. 192–201.
Martin White, Developments in Jet Dyeing, 1998, Rev. Prog. Coloration, pp. 80–94, vol. 28.
N. E. Houser, Wet Processing of Cotton/Spandex Fabrics, 1998, AATCC Symposium, Elastrics, pp. 192–201, Nov. 2–3, 1998.
Lloyd Barringer, Jr., Selected Chemistries of Dyebath Lubriants, American Dyestuff Reporter, pp. 68–74 and 102, Sep. 1994.

* cited by examiner

*Primary Examiner*—Margaret Einsmann
*Assistant Examiner*—Eisa Elhilo

(57) ABSTRACT

A method for jet-dyeing fabrics, which contain elastomeric fibers, by pre-heating the dyebath prior to introducing the fabric, is provided.

7 Claims, No Drawings

METHOD FOR DYEING FABRIC COMPRISING ELASTOMERIC FIBER

BACKGROUND OF THE INVENTION

1. Field of the Invention

This invention relates to a process for dyeing fabrics comprising elastomeric fiber and, more particularly, to such a process which results in dyed fabrics which are substantially free of a particular kind of undesirable nonuniformity, "fractures".

2. Discussion of Background Art

A variety of dyeing and wet-finishing processes have been applied to fabrics. Martin White, *Rev. Prog. Coloration,* Vol. 28, 1998, pp. 80–94, discloses jet-dyeing of spandex-containing fabrics. N. E. Houser, *AATCC Symposium on Elastic Fabrics,* Nov. 2–3, 1998; pp. 192–201, discloses heat setting spandex-containing fabrics after relaxation and before dyeing as an aid in avoiding crease, rope, and crack marks. U.S. Pat. No. 5,399,616, British Patent 1,583,795, and L. Barringer, Jr., *American Dyestuff Reporter,* September 1994, pp. 68ff, disclose the use of lubricants in textile wet processing.

The steps in conventional jet-dye processes for fabric comprising elastomeric fibers have been slitting (when the fabric is a circular knit), pre-heat-setting, tacking the fabric into a tubular form, dyeing (adding the fabric to a dyebath, then adding lubricant and dye, heating the bath at 0.5–1.0° C./minute to the dyeing temperature, cooling the bath at 0.5° C./minute), de-tacking the fabric, drying it, and heat-setting the fabric.

Fractures in elastomeric fiber-containing circular knit fabrics have not been eliminated without slitting, heat setting, and tacking the fabrics before dyeing, and a simpler method of eliminating fractures is still needed.

SUMMARY OF THE INVENTION

The process of this invention for jet-dyeing a fabric comprising an elastomeric fiber comprise the steps of:

(a) providing a jet-dyeing machine;

(b) adding water and a textile dyebath lubricant to the machine to form a bath, and heating the bath to at least about 40° C.;

(c) adding the fabric to the bath after step b);

(d) adding at least one dye to the bath; and (e) heating the bath to the dyeing temperature.

DETAILED DESCRIPTION OF THE INVENTION

By "elastomeric fiber" is meant a staple fiber or continuous filament which, free of diluents, has a break elongation in excess of 100% independent of any crimp and which when stretched to twice its length, held for one minute, and then released, retracts to less than 1.5 times its original length within one minute of being released. Such fibers include spandex, polyetherester fiber, and elastoester, and can be covered with other, non-elastomeric fibers or can be bare (uncovered). "Spandex" is a manufactured fiber in which the fiber-forming substance is a long chain synthetic polymer comprised of at least 85% by weight of a segmented polyurethane.

By "fracture" is meant a short (typically 3 cm or less), sharply defined mark that can appear in a fabric during jet-dyeing, possibly resulting from one or two elastomeric fibers becoming displaced from the plane of the fabric. Fractures are unique to fabrics comprising elastomeric fibers and are so named because, to the naked eye, they can look like cuts in the fabric. Fractures are aligned in the direction of the elastomeric fiber. For example, fractures can appear in the cross-direction in circular knits and either in the cross-direction or the machine-direction in warp knits and wovens, depending on the elastomeric fiber orientation. When the elastomeric fiber is present in the fabric in two directions as in bi-stretch fabrics, fractures can appear as crosses, x's, crow's feet, and the like. In contrast, "creases" are typically longer than fractures, less sharply defined, and are oriented, sometimes obliquely, in the dyeing-machine-direction regardless of fabric machine direction. "Crack marks", which are like sharp creases, always appear in the general direction of the long dimension of the fabric, regardless of elastomeric fiber direction, can be longer and are less sharply defined than fractures. It is speculated that creases and crack marks result from folding of the fabric during wet processing, while fractures result either from a) highly localized drawing and permanent setting of one or two elastomeric fibers at a time after which the resulting longer fiber(s) must bulge out of the plane of the fabric for a short distance, or b) a highly localized inability to accommodate elastomeric fiber retractive forces generated elsewhere in the fabric during wet-finishing. "Rope marks" are dye-deficient areas in a fabric resulting from the inability of dye to penetrate the fabric in the vicinity of rope used to constrain the fabric during dyeing. "Not substantially heat-set" means that a fabric containing a spandex comprising polyurethaneurea has not been heated above about 320° F. (160° C.) under dry conditions or above about 250° F. (121° C.) with steam. For a fabric containing a polyetherester fiber or a spandex comprising polyurethane, it means the fabric has not been heated above about 280° F. (138° C.) under dry conditions or above about 220° F. (105° C.) with steam.

It has now been unexpectedly found that by carrying out the dyeing of a fabric containing elastomeric fiber in a particular way, fractures can be avoided without the necessity of heat-setting the fabric before dyeing it. Further, the present process also gives much higher dye yields, an additional unexpected and beneficial result.

In the process of the invention, an aqueous bath is prepared in a jet-dyeing machine by adding water and a textile dyebath lubricant. The bath is pre-heated to at least about 40° C., typically about 40–60° C. While creases and crack marks can be reduced or eliminated by adding lubricant to the bath after adding the fabric, doing so does not have the same beneficial effect on fractures, and it is a requirement of the inventive process that the water and lubricant be added to the dyeing machine before the fabric is added to the resulting bath. It is, however, immaterial whether the lubricant is added before or after the water is added, or before or after the bath is pre-heated. The lubricant can be used at a level of about 1.0–5.0 g/l, based on the water volume in the bath. The fabric and at least one dye are then added to the bath. After each of the steps of adding the lubricant and adding the fabric, it can be helpful to run the dyeing machine for 5–10 minutes, thoroughly to mix the water and lubricant and to wet the fabric, respectively. However, to minimize further the formation of fractures, it is preferred that the fabric spend less than about 45 minutes in the bath (during fabric wetting and dye addition) before beginning to heat the bath to the dyeing temperature, which heating can take place over a period of less than about 100 minutes. After dyeing is complete, the bath can be cooled. It is preferred that the dyebath be heated rapidly, for example at an average rate of at least about 1° C./minute, and cooled rapidly, for example also at an average rate of at least about 1° C./minute, for maximum avoidance of fractures.

Both tank-type and horizontal (low profile) machines can be used, as can any desired liquor ratio (for example 7:1 to 25:1 weight ratio of dyebath to fabric). Optional pre-process preparations can include relaxing the fabric to avoid structural distortion and uneven dyeing, for example by steaming or pre-scouring. Optional post-dyeing operations can include reduction clearing, soaping, wet or dry heat setting, and the like.

The process of the invention can be carried out with a Samil horizontal (low profile) jet dyeing machine with single jersey circular knits (e.g., 10 wt % Lycra® spandex) and rib knits (e.g., 4 wt % Lycra® spandex) in which the companion fiber can be polyester, nylon, acetate, or rayon, utilizing a lubricant such as 1.5 g/l Lubrigen® BA, resulting in fracture-free fabrics. Due to the elimination of pre-heat-setting, the total dye cycle time can be reduced from 6 hours to 4 hours. Also, dye uptake can be more level than in conventional processes.

In addition to the elastomeric fiber (which is preferably spandex), fibers that can be used in the fabric to be dyed by the present process include cotton, rayon, acetate, and fibers prepared from polycaproamide, poly(hexamethylene adipamide), poly(ethylene terephthalate), poly(trimethylene terephthalate), and the like. Such additional fibers can be companion fibers to the spandex, for example as a covering for the spandex, or they can be knit or woven into the fabric along with, or separately from, the spandex.

Fabrics that can be used in the present process include circular knits, warp knits, flat weft knits, and wovens. In the case of circular knits especially, a dramatic reduction in the number of steps is possible as a result of eliminating the need for heat-setting the fabric before dyeing. Conventionally, such knits have been slit open, pre-heat-set, tacked back into a cylindrical shape, dyed, de-tacked, dried, and post-heat-set. With the present process, circular knits free of fractures can be prepared in just four steps: dyeing, slitting open, drying, and post-heating.

Lubricants that can be used in the process of the invention include those typically used in the dyeing of textiles, including metal salts of fatty acid sulfates and sulfonated fatty acid esters, fatty amides, fatty acid ethoxylates, polyacrylates, poly(acrylamide-co-acrylic acid)s, polysiloxanes, and paraffins, as described in *American Dyestuff Reporter,* September 1994, pp. 68 ff. Use of unsaturated fatty acids, however, was observed to generate fuming during heat setting and to create oil spots, and such lubricants can degrade spandex. Such lubricants are therefore not preferred.

The dyes used in the present process can include disperse, cationic, acid, and metallized dyes, and, especially with cotton, fiber-reactive dyes and direct dyes. Typical dyeing times at the dyeing temperature can be those conventionally used, for example about 25–45 minutes at 100–125° C.; such conditions can be readily adjusted by one skilled in the dyeing art to suit the selected fibers and dyes.

EXAMPLE 1

A fabric was knit on a 28 needles/inch (11 needles/cm) circular knitting machine from 78 dtex Lycra® Type 169B spandex (a registered trademark of E. I. du Pont de Nemours and Company) plated into every course with a 30 singles (180 denier, 200 decitex) textured staple poly(ethylene terephthalate) yarn. The fabric was 11 wt % spandex and 89 wt % polyester.

A Scholl Bleachstar (tank type) jet-dyeing machine was used at a nozzle pressure of 14 psi (97 kPa), a nozzle diameter of 80 mm, and a fabric speed of 2.5 minutes per fabric revolution. Water and 2.0 g/l Persoftal® ACL (a lubricant from Bayer) (concentration based on water volume) were added to the machine. The resulting dyebath was heated to 40° C., and the machine was run for 5 minutes. The knit fabric was added; the dyebath/fabric (liquor) weight ratio was 10:1. The machine was run for 10 minutes, after which 1.5 g/l (based on water) of Sandacid VS (a pH control agent from Sandoz) was added. The machine was closed, and pre-mixed dyes were added from an addition tank. The dyes and their concentration (wt % based on fiber) were 1.175% Foron Brilliant Yellow S6GL (C.I. Disperse Yellow 231), 0.915% Foron Rubine RD-GFL 200, and 2.925% Foron Navy RD RLS-300 (all from Clariant). The choice of these dye concentrations was based on experience with conventional dyeing processes. The dyebath was heated at a rate of 1.5° C./minute. When the temperature reached about 95° C., the bath pH was checked and determined to be 5–6. After the bath reached 120° C., the machine was run for 30 minutes, then cooled at 1.5° C./minute to 80° C. In a reduction clearing step, sodium hydroxide and thiourea dioxide (each at 2.0 g/l of bath volume) were added, and the pH was checked to ensure that it was above 10. The machine was run for 20 minutes, and while the bath was being cooled, the fabric was rinsed with overflow at 70° C. and again at 60° C. The dyed fabric was dried at 160° C. with a Santex drier, slit, and dry heat-set on a tenter frame at 88° C. for 30 seconds. The resulting black fabric exhibited no fractures.

EXAMPLE 2

Example 1 was repeated except that the amounts of dye were decreased to 0.47% Foron Brilliant Yellow S6GL (C.I. Disperse Yellow 231), 0.37% Foron Rubine RD-GFL 200, and 1.71% Foron Navy RD RLS-300, and the 120° C. dyeing step was run for 45 minutes instead of 30 minutes. Even at this reduced dye level (40–60% of the amount typically used on a fabric of this composition and construction), the color of the dyed fabric was a satisfactory black, indicating much higher dye yield and consequently much more efficient use of the dyes than with a conventional dyeing process.

COMPARISON EXAMPLE

Comparable fabrics, which had not been pre-heat set, dyed by a conventional process, for example placed into a jet dyebath before the lubricant and run for 60 minutes at no more than about 30° C., heated at an average rate of 0.6° C./minute over a period of 140 minutes to dyeing temperature, followed by cooling at 0.5° C./minute, exhibited an unacceptable number of fractures.

What is claimed is:

1. A process of jet-dyeing a fabric comprising an elastomeric fiber, comprising the steps of:

(a) providing a jet-dyeing machine;

(b) adding water and a textile dyebath lubricant to the machine to form a bath, and heating the bath to at least about 40° C.;

(c) adding the fabric to the bath after step (b);

(d) adding at least one dye to the bath; and (e) heating the bath to the dyeing temperature.

2. The process of claim 1 wherein in step (b) the bath is heated to 40–60° C., the lubricant is present at a level of about 1.0–5.0 g/l based on water volume, and steps (c) and (d) combined take less than about 45 minutes.

3. The process of claim 1 wherein the elastomeric fiber is spandex, and step (e) takes less than about 100 minutes.

4. The process of claim 1 wherein step (e) is carried out at an average rate of at least 1° C./minute.

5. The process of claim 1 further comprising an additional step (f) of cooling the bath at an average rate of at least 1° C./minute.

6. The process of claim 1 wherein the dye is a disperse dye and the elastomeric fiber is a spandex.

7. The process of claim 5 wherein the elastomeric fiber is spandex, the fabric is not substantially heat-set before step (c), steps (c) and (d) combined take less than about 45 minutes, step (e) takes less than about 100 minutes.

* * * * *